US009466209B2

(12) United States Patent
Blandin et al.

(10) Patent No.: US 9,466,209 B2
(45) Date of Patent: Oct. 11, 2016

(54) TRAFFIC NETWORK SENSOR PLACEMENT

(71) Applicant: International Business Machines Corporation, Armonk, NY (US)

(72) Inventors: Sebastien Blandin, Singapore (SG); Saif Eddin Jabari, Yorktown Heights, NY (US); Laura Wynter, Westport, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/592,948

(22) Filed: Jan. 9, 2015

(65) Prior Publication Data

US 2016/0203712 A1 Jul. 14, 2016

(51) Int. Cl.
*G08G 1/01* (2006.01)

(52) U.S. Cl.
CPC ..... *G08G 1/0125* (2013.01)

(58) Field of Classification Search
CPC ..... G08G 1/0104; G08G 1/0116; G08G 1/0125; G08G 1/0129; G08G 1/0133
See application file for complete search history.

(56) References Cited

U.S. PATENT DOCUMENTS 5,696,503 A * 12/1997 Nasburg ..... G08G 1/0104 340/933
5,774,569 A 6/1998 Waldenmaier
5,801,943 A * 9/1998 Nasburg ..... G08G 1/0104 340/910
7,348,895 B2 * 3/2008 Lagassey ..... G07C 5/008 340/907
8,310,359 B2 11/2012 Abedi
8,903,636 B1 * 12/2014 Al Kandari ..... G08G 1/0145 701/118
9,286,797 B1 * 3/2016 Blandin ..... G08G 1/0125
2008/0004789 A1 * 1/2008 Horvitz ..... G01C 21/3492 701/117
2009/0002195 A1 * 1/2009 Horvitz ..... G08G 1/0104 340/934
2011/0208417 A1 * 8/2011 Fink ..... G01C 21/3676 701/532
2013/0063282 A1 3/2013 Baldwin et al.
2014/0232564 A1 * 8/2014 Garay ..... G08G 1/0116 340/934
2014/0232600 A1 * 8/2014 Larose ..... G01S 5/0205 342/463

(Continued)

FOREIGN PATENT DOCUMENTS

GB 2495383 A 4/2013
WO 2004023413 A2 3/2004

(Continued)

OTHER PUBLICATIONS

Kianfar et al., "Optimizing Freeway Traffic Sensor Locations by Clustering Global Positioning System Derived Speed Patterns," IEEE Transactions on Intelligent Transportation Systems, Sep. 2010, pp. 738-747 DOI: 10.1109/TITS.2010.2051329.

(Continued)

*Primary Examiner* — Jerrah Edwards
*Assistant Examiner* — Tamara Weber
(74) *Attorney, Agent, or Firm* — Laura E. Gisler; Daniel P. Morris

(57) ABSTRACT

Locations for traffic sensors can be determined by a computer system that identifies a particular segment of a travel path. Traffic flow data from other segments of travel path are accessed based on traffic flow characteristics of the particular path. Using the traffic flow data, parameters for a traffic incident symptom propagation model are generated, and a location of a traffic incident along the segment of the path is determined. Using time-to-detection limits and the incident model, upstream and downstream distances are determined, and the locations of two sensors are identified based on the distances.

15 Claims, 8 Drawing Sheets

(56) References Cited

U.S. PATENT DOCUMENTS

| | | | | |
|---|---|---|---|---|
| 2015/0145663 | A1* | 5/2015 | Moon | G07C 5/008 340/436 |
| 2015/0206426 | A1* | 7/2015 | Bradley | G08G 1/0141 701/118 |
| 2015/0221218 | A1* | 8/2015 | Downs | G08G 1/0129 701/119 |

FOREIGN PATENT DOCUMENTS

| | | | |
|---|---|---|---|
| WO | 2005111602 | A2 | 11/2005 |
| WO | 2009006059 | A2 | 1/2009 |

OTHER PUBLICATIONS

Ma, Y., "A Real-Time Traffic Condition Assessment and Prediction Framework Using Vehicle-Infrastructure Integration (VII) With Computational Intelligence," A Dissertation Presented to the Graduate School of Clemson University, May 2008.

Singliar, T., "Research statement," Jul. 22, 2008, 4 pages.

Aamo et al., "Observer Design Using Boundary Injections for Pipeline Monitoring and Leak Detection," International Symposium on Advanced Control of Chemical Processes, Apr. 2-5, 2006, Gramado, Brazil.

Ban et al., "Optimal Sensor Placement for Freeway Travel Time Estimation," Transportation and Traffic Theory 2009: Golden Jubilee, Jun. 16, 2009, pp. 697-721.

Berry et al., "Sensor Placement in Municipal Water Networks with Temporal Integer Programming Models," Journal of Water Resources Planning and Management, Jul./Aug. 2006, vol. 132, No. 4.

Danczyk et al., "A mixed-integer linear program for optimizing sensor locations along freeway corridors," Transportation Research Part B 45, 2011, pp. 208-217, Copyright 2010 Elsevier Ltd. DOI: 10.1016/j.trb.2010.04.002.

Fei et al., "Structural analysis of near-optimal sensor locations for a stochastic large-scale network," Transportation Research Part C 19, 2011, pp. 440-453, Copyright 2010 Elsevier Ltd. DOI: 10.1016/j.trc.2010.07.001.

Fei et al., "Vehicular network sensor placement optimization under uncertainty," Transportation Research Part C 29, 2013, pp. 14-31, Copyright 2013 Elsevier Ltd. http://dx.doi.org/10.1016/j.trc.2013.01.004.

Gentili et al., "Locating sensors on traffic networks: Models, challenges and research opportunities," Transportation Research Part C 24, 2012, pp. 227-255, Copyright 2012 Elsevier Ltd. http://dx.doi.org/10.1016/j.trc.2012.01.004.

Goulet et al., "Model falsification diagnosis and sensor placement for leak detection in pressurized pipe networks," Advanced Engineering Informatics 27, 2013, pp. 261-269, Copyright 2013 Elsevier Ltd. http://dx.doi.org/10.1016/j.aei.2013.01.001.

He, S., "A graphical approach to identify sensor locations for link flow inference," Transportation Research Part B 51, 2013, pp. 65-76, Copyright 2013 Elsevier Ltd. http://dx.doi.org/10.1016/j.trb.2013.02.006.

Hu et al., "Identification of vehicle sensor locations for link-based network traffic applications," Transportation Research Part B 43, 2009, pp. 873-894, Copyright 2009 Elsevier Ltd. DOI: 10.1016/j.trb.2009.02.008.

Krause et al., "Efficient Sensor Placement Optimization for Securing Large Water Distribution Networks," Journal of Water Resources Planning and Management, Nov./Dec. 2008, pp. 516-526, © ASCE.

Li et al., "Reliable sensor deployment for network traffic surveillance," Transportation Research Part B 45, 2011, pp. 218-231, Copyright 2010 Elsevier Ltd. DOI: 10.1016/j.trb.2010.04.005.

Murvay et al., "A survey on gas leak detection and localization techniques," Preprint version of the article accepted in Journal of Loss Prevention in the Process Industries.

Ng, M., "Synergistic sensor location for link flow inference without path enumeration: A node-based approach," Transportation Research Part B 46, 2012, pp. 781-788, Copyright 2012 Elsevier Ltd. DOI: 10.1016/j.trb.2012.02.001.

Reddy et al., "Leak detection in gas pipeline networks using an efficient state estimator. Part-I: Theory and simulations," Computers and Chemical Engineering 35, 2011, pp. 651-661, Copyright 2010 Elsevier Ltd. DOI: 10.1016/j.compchemeng.2010.10.006.

Reddy et al., "Leak detection in gas pipeline networks using an efficient state estimator. Part II. Experimental and field evaluation," Computers and Chemical Engineering 35, 2011, pp. 662-670, Copyright 2010 Elsevier Ltd. DOI: 10.1016/j.compchemeng.2010.10.011.

Sherali et al., "A discrete optimization approach for locating Automatic Vehicle Identification readers for the provision of roadway travel times," Transportation Research Part B 40, 2006, pp. 857-871, Copyright 2006 Elsevier Ltd. DOI: 10.1016/j.trb.2005.11.003.

Simonelli et al., "A network sensor location procedure accounting for o-d matrix estimate variability," Transportation Research Part B 46, 2012, pp. 1624-1638, Copyright 2012 Elsevier Ltd. http://dx.doi.org/10.1016/j.trb.2012.08.007.

Verde et al., "Bank of Nonlinear Observers for the Detection of Multiple Leaks in a Pipeline," Proceedings of the 2001 IEEE International Conference on Control Applications, Sep. 5-7, 2001, pp. 714-719, Mexico City, Mexico, Copyright 2001 IEEE.

Watson et al., "A Multiple-Objective Analysis of Sensor Placement Optimization in Water Networks," Critical Transitions in Water and Environment Resources Management, pp. 1-10, © 2004 American Society of Civil Engineers DOI: 10.1061/40737(2004)456.

Blandin et al., "Traffic Incident Location Identification," Filed Jan. 9, 2015.

* cited by examiner

TRAFFIC NETWORK SENSOR PLACEMENT

BACKGROUND

The present disclosure relates to a system and method for identifying the placement of traffic sensors over a network, and more specifically, to determine a distance between sensors based on time-to-detection constraints.

Traffic management systems can integrate technology to improve the flow of vehicle traffic and improve safety. Often times, they use real-time traffic data from cameras and speed sensors to improve traffic flow.

SUMMARY

Embodiments of the present disclosure are directed toward a computer implemented method for identifying locations of sensors on a travel path. A particular segment of a travel path that has traffic flow characteristics is identified, and traffic flow data for segments of a set of travel paths can be accessed based upon the traffic flow characteristics. Based on the accessed traffic flow data, the system can generate parameters for a traffic incident symptom propagation model. The system can determine, based upon the traffic incident symptom propagation model for the particular segment, a traffic incident location along the particular segment of the travel path, and determine, based on a first time-to-detection limit and using the traffic incident symptom propagation model, an upstream distance. A downstream distance can also be determined, based on the first time-to-detection limit and using the model, a downstream distance. Based on the upstream and downstream distances, the system can output a sensor location on the particular segment of the travel path for a first sensor and a second sensor.

Embodiments of the present disclosure may also be directed toward a computer system comprising at least one processor circuit configured to identify locations of sensors on a travel path. A system's processor circuit may comprise a path identifier module configured to identify a particular segment of a travel path that has traffic flow characteristics and access, based upon the traffic flow characteristics, traffic flow data for segments of a set of travel paths. The system's processor circuit may also include a developer module configured to generate, based on the accessed traffic flow data, parameters for a traffic incident symptom propagation model, and determine, based upon the traffic incident symptom propagation model for the particular segment, a traffic incident location along the particular segment of the travel path. A circuit can also be configured to include a distance determining module that can be configured to determine, based on a specified time-to-detection limit and using the model, an upstream distance, and determine, based on the specified time-to-detection limit and using the model, a downstream distance. A circuit may include a report module configured to output, based upon the upstream and downstream distances, a sensor location on the particular segment of the travel path for a first sensor and a second sensor.

Embodiments of the present disclosure may also be directed toward a computer program product for identifying a sensor location. The computer program product may comprise a computer readable storage medium that is not a transitory signal per se, the program instructions executable by a computer processing circuit to cause the circuit to perform the method that may include identifying a particular segment of a travel path that has traffic flow characteristics. The method may further include accessing, based upon the traffic flow characteristics, traffic flow data for segments of a set of travel paths; generating, based on the accessed traffic flow data, parameters for a traffic incident symptom propagation model; and determining, based upon the traffic incident symptom propagation model for the particular segment, a traffic incident location along the particular segment of the travel path. The method may further include determining, based on a first time-to-detection limit and using the traffic incident symptom propagation model, an upstream distance; determining, based on the first time-to-detection limit and using the model, a downstream distance; and outputting, based upon the upstream and downstream distances, a sensor location on the particular segment of the travel path for a first sensor and a second sensor.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
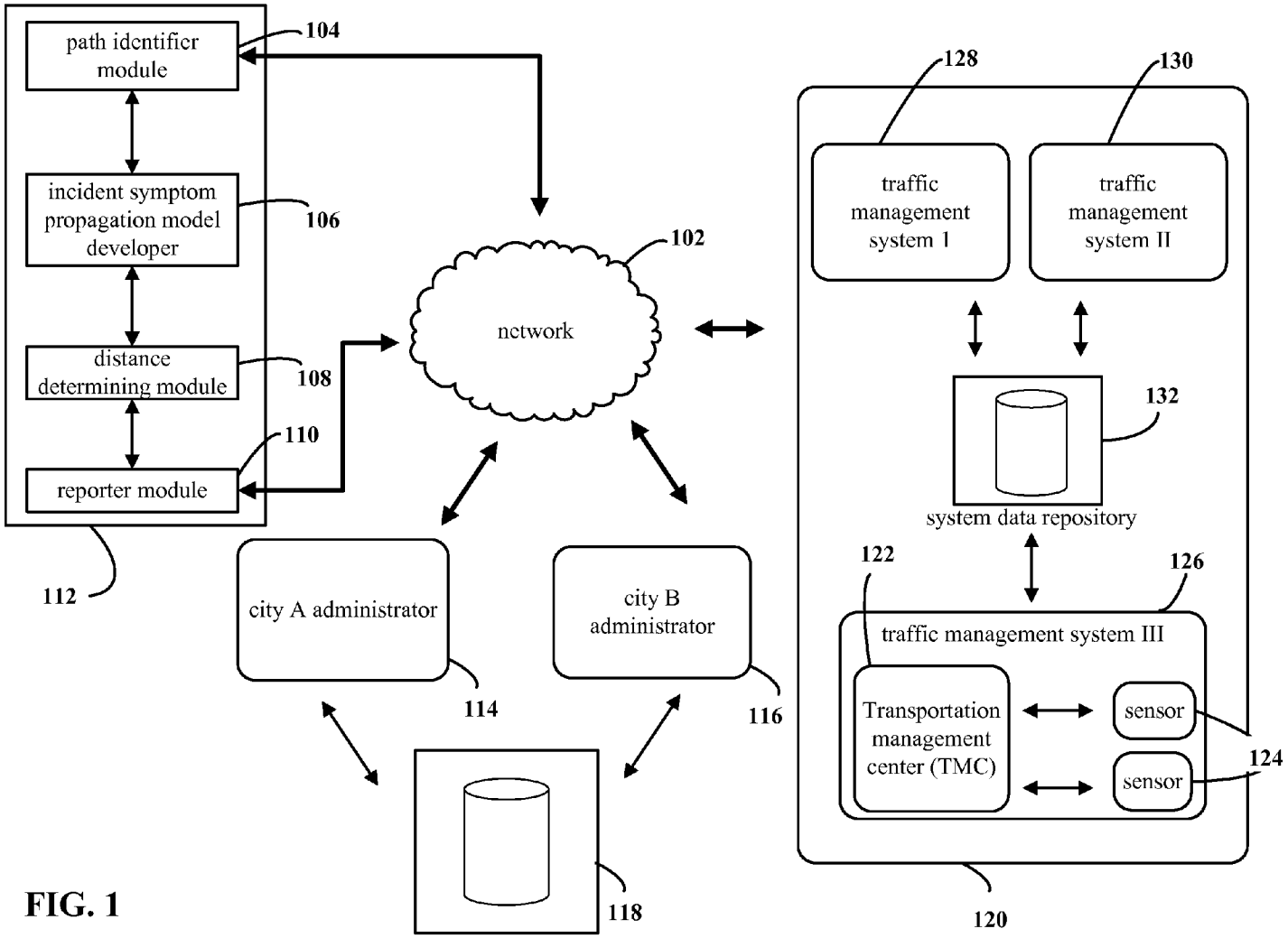
FIG. 1 depicts a system for determining the placement of sensors along a traffic path, within time-to-detection constraints, using traffic data, consistent with embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to the placement of sensors along a path, more particular aspects relate to determining a distance between sensors, while offering time-to-detection guarantees. While the present disclosure is not necessarily limited to such applications, various aspects of the disclosure may be appreciated through a discussion of various examples using this context.

Fixed sensors on expressway networks can be widely spaced, so that the time at which an incident is detected at a traffic sensor may be several minutes after it has taken place. Aspects of the present disclosure relate to a system that can be used to determine traffic sensor locations that have time-to-detection guarantees. Herein, embodiments relate to a method for determining the placement of sensors at intervals to be able to provide guarantees on the time-to-detection of the incident are discussed.

Sensor placement can take different approaches. In some cases, the goal is to place sensors along the roadway with a budget on the number or cost of sensors so as to maximize the benefit accruing from the sensor placement, where the benefit may be related to the quality or accuracy of the traffic level readings that they would provide. In other cases, the objective is to be able to accurately reproduce origin-destination demands. For example, an origin-destination demand could be a time-to-detection limit, where a time budget is specified as to an acceptable length of time between an incident's occurrence and its detection by a sensor.

Consistent with embodiments, a sensor placement system can identify a particular segment of a travel path (like a highway) that has particular traffic flow characteristics. The system can use traffic flow data from roadways with similar traffic flow characteristics in order to predict various elements of traffic flow, which can include: traffic density (which can represent the mean number of vehicles at a specified time in a section of the road, divided by the section length), the mean rate of flow (based on vehicles crossing a specified position over a short interval of time), and the (space) mean speed of vehicles. The traffic flow data may also include other data about the traffic on a particular segment of the road.

Consistent with embodiments, the sensor placement system can generate parameters for a traffic incident symptom propagation model, based upon traffic flow data from a set of roadways with similar traffic flow characteristics. Using the traffic incident symptom propagation model, a traffic incident location along the particular segment of the travel path can be determined. This location can be identified by using a local search optimization algorithm, in order to determine a location of a traffic incident that would take the longest time to be detected by both of the sensors, based on the propagation speed of the traffic incident symptom. For instance, a time-to-detection limit can be applied it to the model to determine an upstream distance. For example, this distance can relate the propagation speed of the traffic incident symptom to the time-to-detection limit, by, determining the distance from the traffic incident the symptom can travel in the maximum allowed time, as given by the specified time-to-detection limit. For purposes herein, the term traffic incident symptom, or "symptom", is used to describe the indicator of a traffic incident which can be conceptualized to propagate as a shockwave through traffic on a roadway, in either direction from the incident.

Using the time-to-detection limit and applying it to the model, a downstream distance can be determined. Like the upstream distance, this distance can relate the symptom propagation speed, the identified "worst-case" location, and the maximum time-to-detection limit. Herein, the terms upstream and downstream are used to indicate a direction along the travel path, with downstream being a farther distance down the travel path following the flow of traffic. Upstream, then, is used to refer to locations up the travel path from the traffic incident location, against the direction of the traffic flow.

Consistent with embodiments, using the upstream and downstream distances relative to the determined location of a traffic incident, a location for each of the first and second sensors along the travel path can be identified and output by the system. This system can then be used to determine the location of a plurality of sensors along the same travel path, using the same or different parameters, including different time-to-detection limits.

Turning now to the figures, FIG. 1 depicts a sensor placement system for determining the placement of sensors along a traffic path, within time-to-detection constraints, using traffic data, consistent with embodiments. A city "A" administrator 114 can select a particular segment of a travel path with traffic flow characteristics on which traffic sensors need to be installed. This selection can be transmitted, over a network 102, to a computer system, depicted herein as a locating system 112, comprising a computer processing circuit having a path identifier module 104. The path identifier module 104 can process the specified portion of roadway and, based on the particular traffic characteristics of the specified portion of roadway, identify other travel paths with similar traffic characteristics. The identifier module 104 can identify these travel paths by accessing a data repository 132 for a network of traffic management systems 120.

Consistent with embodiments, the network of traffic management system's data repository 132 can contain locations and characteristics of numerous travel paths. The system data repository can store data from a number of traffic management systems, including system I 128, system II 130, and system III 126. Details of a particular traffic management system (in this instance, system III 126) can include a transportation management center (TMC) that received data from a number of sensors 124. Traffic management system III 126 can store traffic flow data collected from sensors 124 and processed by TMC 122 in a system data repository 132. A path identifier module 104 of the locating system 112 can access data from the system repository 132, in order to identify the particular travel path and its traffic flow characteristics, as well as the locations and traffic flow data from similarly characterized travel paths, i.e. roadways.

Consistent with embodiments, the path identifier module 104 can communicate with a locating system's 112 incident symptom propagation model developer module (herein "developer model module") 106. The path identifier module 104 can pass data collected about the particular path and correlated traffic flow characteristics. From this data, a developer module 106 can develop an incident symptom propagation model. The incident symptom propagation model can be used by a distance determining module 108 to calculate a distance upstream and downstream along the particular travel path for sensor placement. This data can be accessed by the reporter module 110 of the locating system 112, and the results—the location of the two sensors—can be communicated back to a user like a city A administrator 114 over a network 102.

Consistent with embodiments, this sensor location data communicated by the reporter module 110 over the network 102 to a city A administrator 114, can be stored in a data repository 118. In some cases, this data, and other traffic data, can be accessed in part or whole by other users, for example a city "B" administrator 116. A city B administrator could access data stored 118 by city A administrator 114 in order to better plan a city B roadway system. Another user, like city B administrator 116 could also access, over a network 102, a network of traffic management systems 120. Similar to access to the repository 118, city B administrator 116's access to the raw data, processed data, or both from the network of traffic management systems 120 could be partially restricted, in order to allow for either full or partial sharing of traffic flow data.

Figure 2:
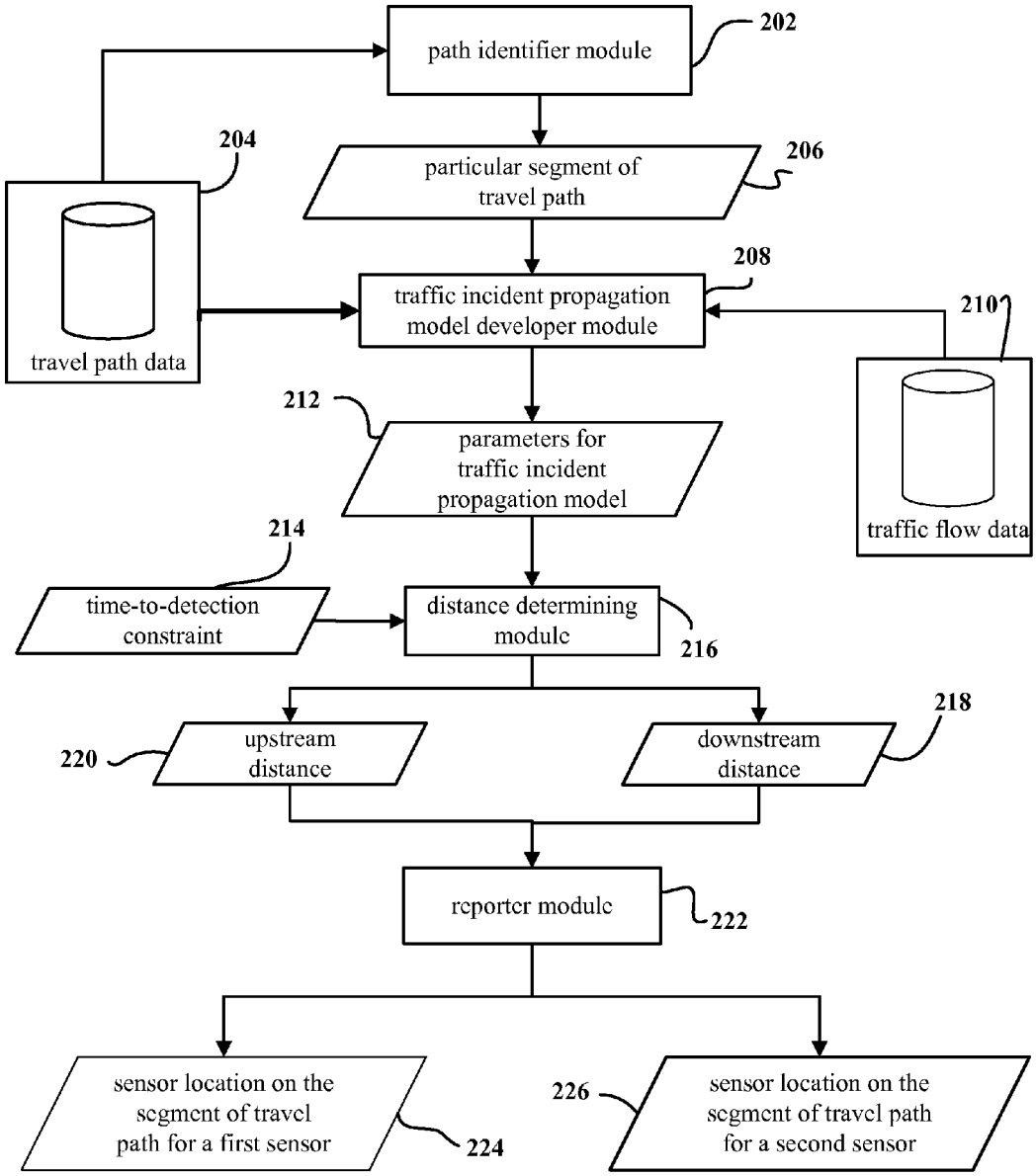
FIG. 2 depicts a data flow diagram for a system to determine the placement of traffic sensors, according to embodiments.

FIG. 2 depicts a data flow diagram for a system to determine the placement of traffic sensors, consistent with embodiments. The modules depicted in this figure can be the modules listed in FIG. 1 as 104-110. For instance, the modules can reside in a locating engine, depicted 112 in FIG. 1. The figure depicts the flow of data across modules, as labeled and indicated by parallelograms, with rectangles signifying modules. The flow of data can begin when a computer system having at least one processor circuit comprising a path identifier module 202, is configured to accesses travel path data, per block 204. From the data 204, the module 202 can identify a particular segment of a travel path, per 206. This segment can have traffic flow characteristics that can be used by a traffic incident propagation model developer module ("developer module"), 208, in conjunction with traffic flow data 210 from segments of a set of travel paths contained in a travel path data repository 204, to develop parameters for a traffic incident propagation model, per 212.

For example, this model can account for the variation in speeds of the upstream and downstream directed shockwaves or symptoms of the traffic incident. The model can also account for variations in the speed of the shockwave over a distance, with the speed being other than a constant. A time-to-detection constraint 214 can be applied to the model, in order to constrain the results to a specified maximum time between the occurrence of an incident and its detection. Using the determined parameters, a distance determining module, per 216, can calculate an upstream and downstream distance, 220 and 218, respectively, using the traffic incident propagation model.

Using the calculated upstream distance 220 and downstream distance 218, a reporter module 222 can output locations on the travel path for a first sensor 224 and a second sensor 226 based on the calculated distances at 220 and 218.

Figure 3:
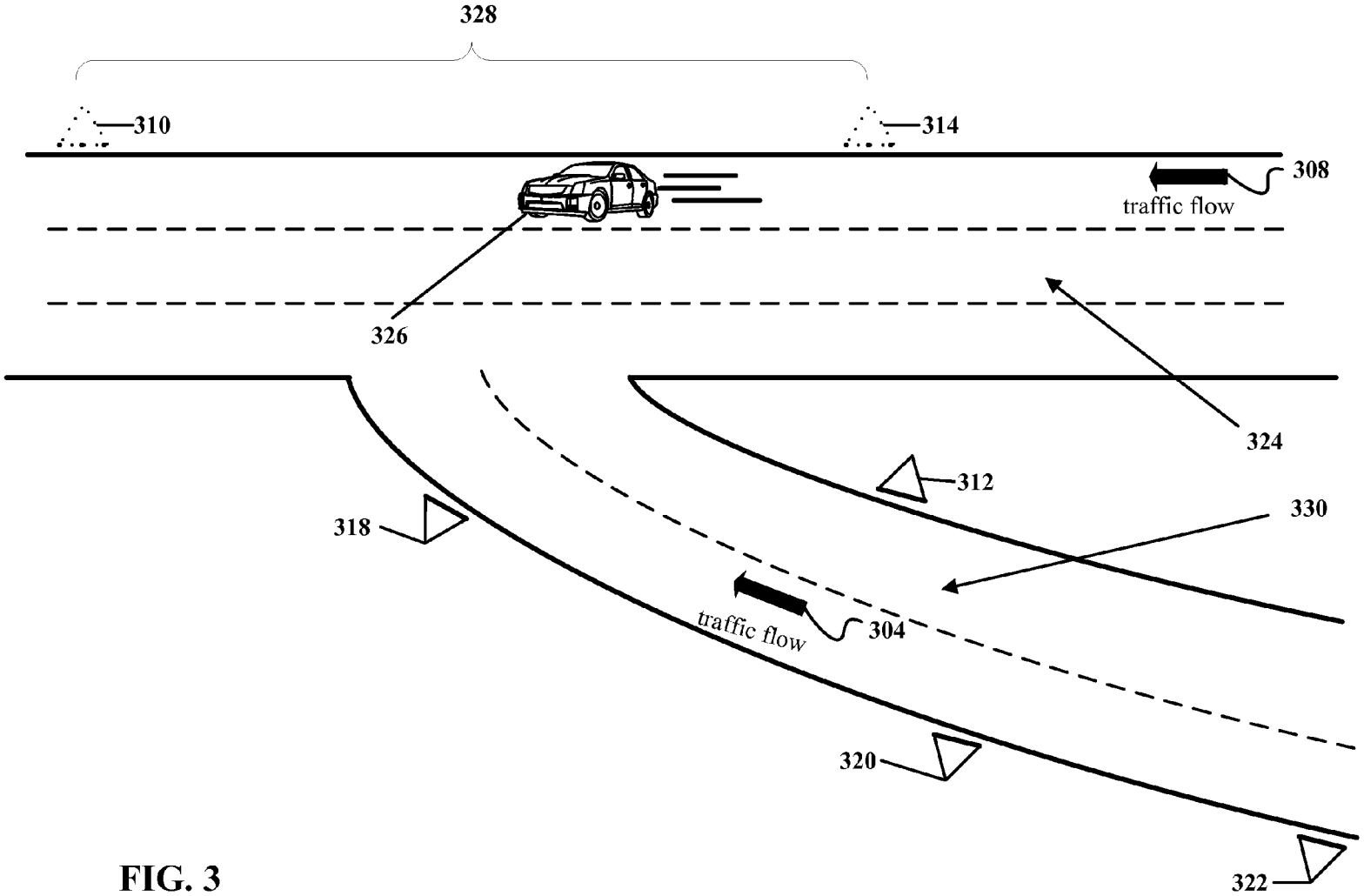
FIG. 3 depicts a use case of the sensors, along a travel path, according to embodiments.

FIG. 3 depicts a use case of the sensors, along a travel path, consistent with embodiments. The diagram depicts a travel path, a highway 324, as an on-ramp 330 merges with the highway 324. The arrows 308 and 304 show the direction of the flow of traffic, with traffic moving in a single direction, and the merging traffic joining the flow. A vehicles labeled 326 is moving along the highway 324 in the direction of the flow of traffic, per arrow 308. At points along the on-ramp 330, traffic sensors 312, 318, 320, and 322 can collect traffic flow data from that portion of the highway. Triangles 310 and 314 are traffic sensors which have not yet been installed along a new stretch of highway, their locations in the figures approximations of the installation location. Their actual/final installation locations can be determined by the system. A distance, 328, between the two can be used to replicate the identified locations of a sensor 314 relative to a first sensor 310.

Consistent with embodiments, traffic flow data can be used to develop parameters for a traffic incident symptom propagation model. This data can include mean rate of traffic flow, traffic density or a mean speed of vehicles along a particular segment of travel path. The system could also use further processed data including a free-flow speed of traffic, roadway capacity, a determined critical density, or others. This data could be associated with a particular segment of the roadway, and could exist for any number of segments along a roadway. For example, the data could be collected and processed by existing traffic management systems, using sensors and TMC, as described herein. The data could also be sourced from a data repository or input by a user into the system. Importantly, the traffic data could define certain characteristics of a travel path, which could then be correlated with a portion of roadway that still requires sensor installation, like highway 324, in order to develop parameters for a traffic incident propagation model. Additionally, a time-to-detection limit or "budget" can be specified by a user or owner of the traffic management system for which the sensors are being installed. For example, an owner could specify that a particular incident needs to be identified within "x" number of seconds after it has occurred. This budget, "x", could also be used by the system in the development of the model.

Consistent with embodiments, applying the parameters to the model, on the particular travel path, here highway 324 that vehicle 326 is travelling on, the system can determine a traffic incident location along the path and between sensors 310 and 314. The location could be at any point between sensor 310 and sensor 314, as determined by the model, which can take into account speeds of travel of traffic incident symptoms in each direction (i.e. conceptually, the propagation speed of shockwaves moving toward each sensor from a location between the sensors). Using the model, distances from the determined traffic incident location can be calculated. Those distances can be used to determine the locations of sensors 310 and 314, and the length of the distance 328 can be determined in order to replicate the spacing for additional sensors along the highway 324.

Consistent with embodiments, the distance 328 can also change for additional sensors placed along the travel path. For example, a different time-to-detection limit could be specified for the next set of sensors along the travel path. New traffic flow data could also be collected, in order to reflect new traffic flow characteristics of the next segment of travel path. This new traffic flow data could impact the parameters for the traffic incident symptom propagation model, resulting in a modified distance between two sensors, when determining the location of a next set of sensors along a next segment of a travel path.

Figure 4:
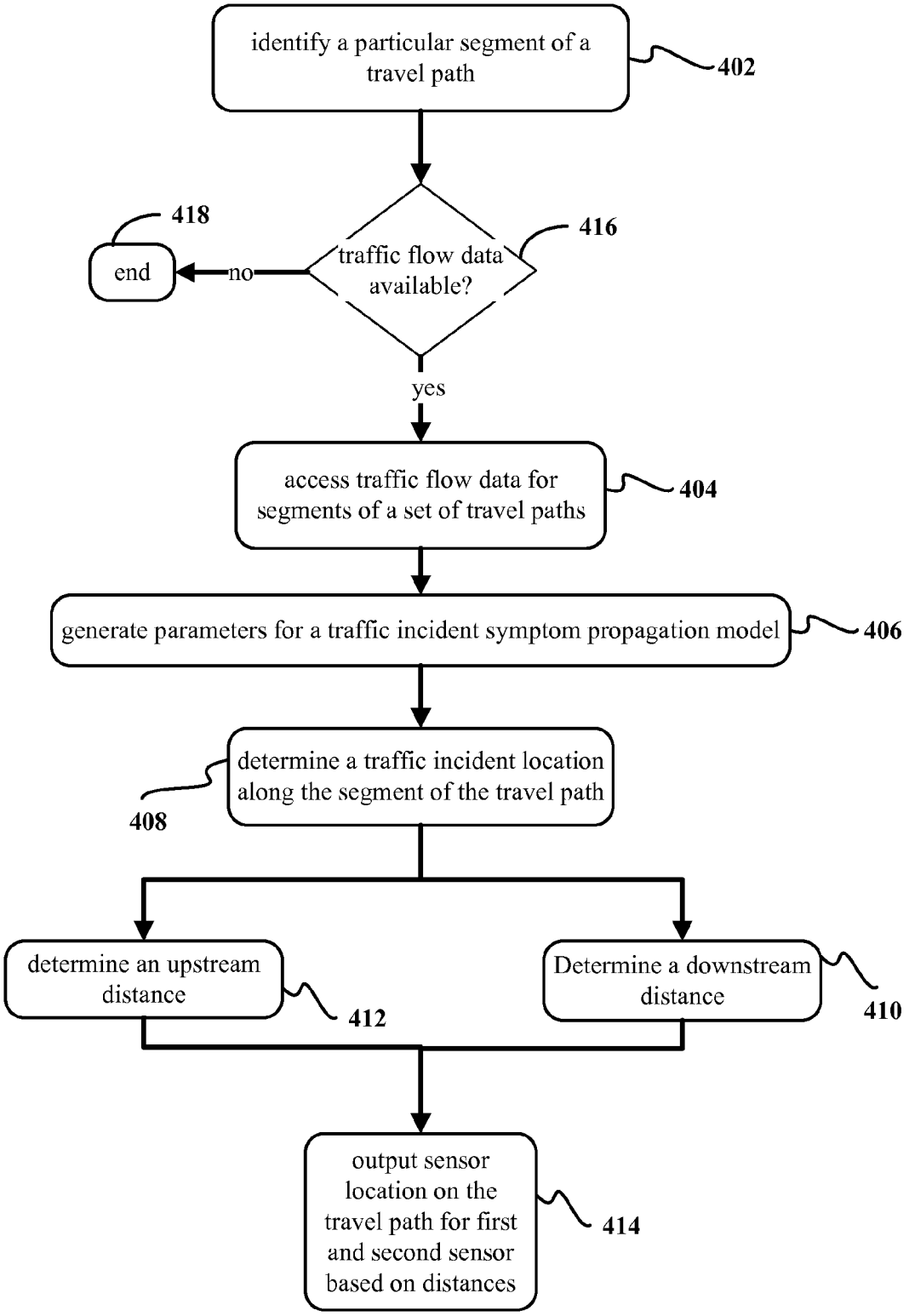
FIG. 4 depicts a flow of a method for determining the spacing between two sensors, within time-to-detection constraints, according to embodiments.

FIG. 4 depicts a flow of a method for determining the spacing between two sensors, within time-to-detection constraints, consistent with embodiments. The flow can begin when a system identifies a particular segment of a travel path that has traffic flow characteristics, per block 402. Per 416, if traffic flow data for other travel paths with similar traffic flow characteristics as the identified segment of travel path, the system can end, per 418. For example, these flow characteristics can include free-flow speed of traffic, a traffic density, a capacity of traffic allowable along the particular segment of the travel path, wherein free-flow traffic is not affected, or a particular traffic density threshold required for the travel path in order that a traffic incident of a particular severity may be detected.

Consistent with embodiments, based on the traffic flow characteristics identified for the particular segment of the travel path, the system can access traffic flow data for segments of a set of travel paths, per block 404. For example, this traffic flow data can be raw or processed data pertaining to the traffic flow characteristics described above, or others. For example, this data can be collected from a sensor, processed by a TMC, stored in a data repository, or accessed in another way, and it can include a mean rate of flow of traffic crossing a position on the segment of roadway, the traffic density of the segment of roadway, the (space) mean speed of vehicles on the segment of the roadway, or others. As mentioned herein, this data can be used to define certain traffic flow characteristics in order to identify segments of roadway similar to the particular segment of travel path of interest.

Consistent with embodiments, using the traffic flow data, the system can generate parameters for a traffic incident symptom propagation model, per block 406. Applying the parameters to the model, a traffic incident location along the segment of the travel path can be determined, per block 408. For example, as mentioned herein, this location could be determined based on incident symptom propagation speed functions for an upstream and downstream symptom. The upstream and downstream incident symptom propagation speeds can also be conceptualized as a speed of a shockwave, moving in each of the upstream and downstream directions along the travel path, emanating from a location of a traffic incident. Thus, the incident location can be determined relative to the shockwave (or incident symptom propagation speed) functions. Using the traffic incident symptom propagation model, with the parameters developed at block 406, and the incident location determined at 408, an upstream and downstream distance can be calculated, per blocks 412 and 410, respectively. For example, using the symptom or shockwave conceptualization from above, the upstream and downstream distance can be the distance from the determined incident location the shockwave (or symptom) can travel in each direction (respectively), within the time-to-detection limit or "budgeted" time "x". Per block 414, the sensor location along the travel path for the first sensor and for the second sensor can be determined based on the distances calculated at blocks 412 and 410, and be output to a user, including another system.

Consistent with embodiments, the system can repeat, beginning the flow again at 402, and identifying a new or next segment of a travel path with a new or same set of traffic flow characteristics. For example, a third sensor location could be identified along the same travel path, relative to the second sensor location. Determining the traffic flow characteristics and using the same or new traffic flow data from similarly-characterized segments of highway, a new traffic incident symptom propagation model can be developed. From the model, a new incident location, on the path between sensors two and three. A different time-to-detection limit "y" can be specified for this segment of the roadway. From the location, and by applying the time-to-detection limit "y", an upstream and downstream distance can be determined, and the third sensor location along the travel path can be identified and communicated accordingly.

Figure 5:
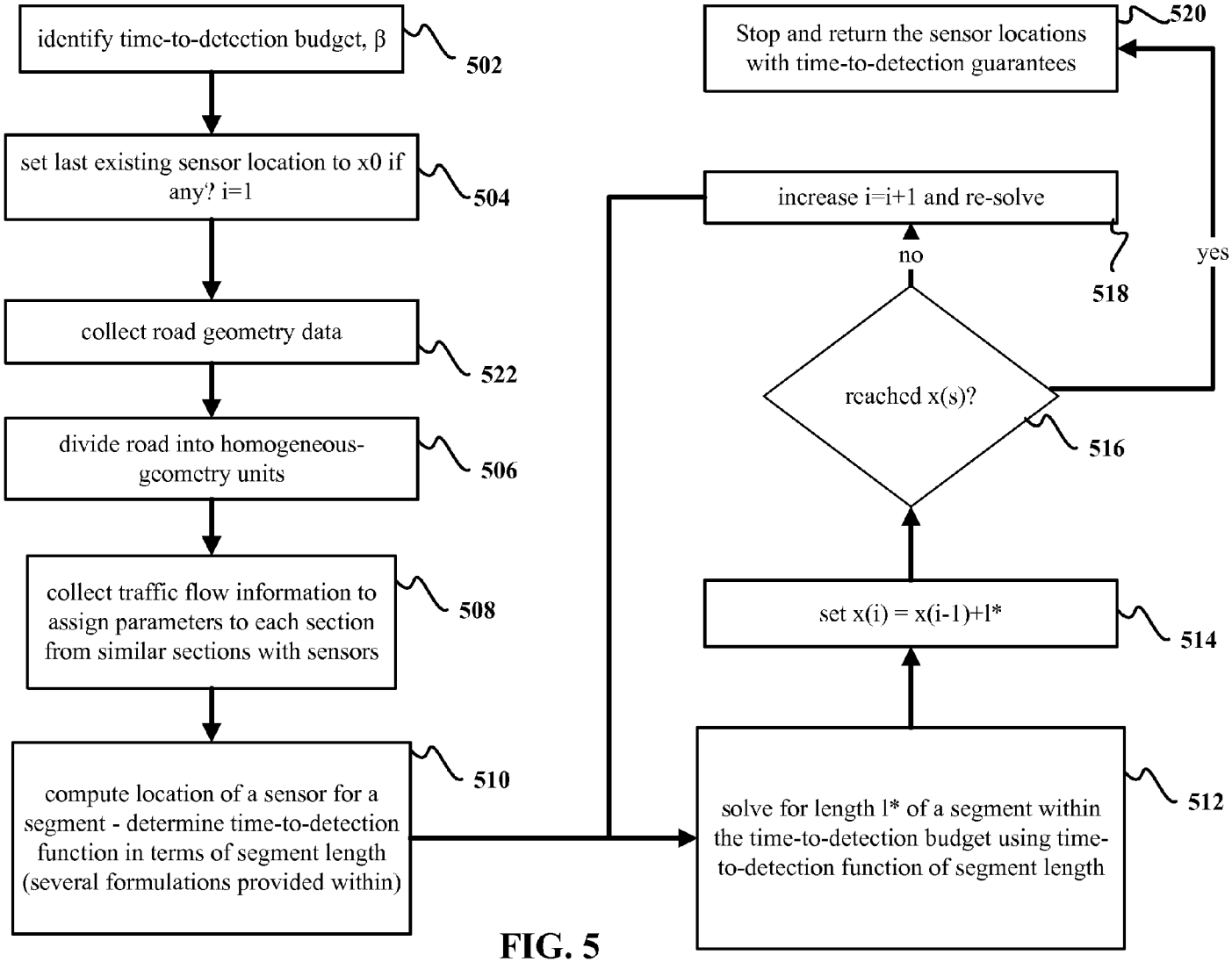
FIG. 5 depicts a flow of a method for calculating sensor locations, according to embodiments.

FIG. 5 depicts a flow of a method for calculating sensor locations, consistent with embodiments. The flow can begin when a time-to-detection budget, A is identified, per 502. This could be supplied by a user or input into the system. According to embodiments, a time-to-detection budget can be a limit on the length of time between the actual occurrence of a traffic incident and the incident's detection by sensors on a travel path or highway. If any sensors already exist on the specified travel path, the last one's location is set to 0, per 504. Road geometry data can be collected, in order to allow for the division of the road into homogenous-geometry units, or segments of the travel path, per block 522 and 506, respectively. Using this information, traffic flow data can be collected in order to assign parameters to each section from similar sections with sensors, per block 508. Here, the system can correlate similar traffic flow data to similar sections of highway or a travel path, in order to extrapolate existing flow data to areas of highway with no or poor traffic data (or for other purposes). Using a model described herein, a system can compute a location of a sensor for a segment by determining a time-to-detection function in terms of the segment length, per block 510.

Here, one of many search optimization techniques could be used to find a solution, in examples herein, a longest time-to-detection location of a traffic incident relative to sensor locations. Local search optimization algorithms can be applied to identify a location for the incident which would demand the longest time-to-detection within the constraints. For example, a symptom propagation module can be used in combination with a hill climbing technique to identify the local maximum of symptom propagation times to the sensors. Other techniques could be used, as a local search could identify a solution necessary for purposes of this disclosure. In some instances, a local search optimization algorithm could be applied in order to detect a location of a traffic incident that would take the longest time to be detected by both of the sensors, based on the propagation speed of the traffic incident symptom. For example, a worst-case location of a traffic incident (or a corresponding sensor location) could be identified.

At 512, a system can solve for a length l* of a segment within the time-to-detection budget using time-to-detection function of segment length. For example, l* can be set to a determined maximal admissible length, based on a specified time-to-detection limit. A system can set $x(i)=x(i-1)+l^*$, per 510, and determine if it has reached x(s), per 516. If x(s) has been reached at 516, a system can stop and return the sensor location with time-to-detection guarantees, per block 520. If x(s) has not been reached at 516, the system will increase $i=i+1$ and re-solve, per 518, following the path to block 512, in order to continue the flow until x(s) has been reached.

Although the model described herein accounts for a closed travel path (i.e. one where it is assumed that there is not gain or loss in the number of vehicles traveling the path, be it via an on-ramp, off-ramp, or others), the various embodiments of the disclosure are not limited to a closed travel path, and may be modified to account for any lack of homogony on a travel path. Similarly, in some embodiments and in some models, traffic conditions are assumed to be in free-flow throughout the roadway section. As with traffic influx, traffic conditions prior to and following the traffic flow data analysis may be variable and the particular model may be adjusted accordingly.

In some embodiments, a first-order continuum traffic flow model can be used to determine the traffic flow characteristics. First-order continuum traffic flow models describe the spatio-temporal evolution of three variables of traffic flow: (i) the traffic density, denoted $\rho(x,t)$, which represents the mean number of vehicles at time instance $t\in\mathbb{R}_+$ in a "small" section of road, relative to the distance between detectors, $$\left(x-\frac{1}{2}dx,\ x+\frac{1}{2}dx\right),$$

divided by the section length dx, (ii) the mean rate of flow, $q(x,t)$, crossing position $x\in\mathbb{R}$ over the short time interval $$\left(t-\frac{1}{2}dt,\ t+\frac{1}{2}dt\right),$$

and (iii) the (space) mean speed of vehicles, $v(x,t)$ in $(x-dx,x+dx)$ during $(t-dt,t+dt)$. By definition of the traffic variables, $q=\rho v$ and, consequently, any two of the three macroscopic variables can be used to describe traffic conditions along the road. A natural rule is the conservation of vehicles (or traffic densities) along the road. In the absence of sources and sinks, this is given by:

$$\frac{\partial \rho}{\partial t} + \frac{\partial q}{\partial x} = 0 \tag{A}$$

To close the conservation equation, an "equilibrium" flow-density relation can be used: $q \equiv Q_e(\phi$, which is typically a non-linear concave relation (also known as the "fundamental diagram" of traffic flow). The resulting model is a non-linear scalar conservation law:

$$\frac{\partial \rho}{\partial t} + \frac{\partial Q_e(\rho)}{\partial x} = 0 \tag{B}$$

To solve (B), knowledge of initial traffic conditions is needed; this is given by a prescribed initial traffic density profile: $\rho(x,0) \equiv \rho_0(x)$ for all $x \in \mathbb{R}$. According to embodiments, this data can be collected by existing sensors located along a travel path. The solution of (B) develops discontinuities known as shockwaves.

Consistent with embodiments, shockwaves describe the spatio-temporal evolution of traffic jams (and their dissipation dynamics). These shockwaves can indicate that a traffic incident has occurred in a location relative to the wave and its direction. For purposes herein, the term traffic incident symptom, or "symptom", is used to describe the indicator of a traffic incident which can be conceptualized to propagate as a shockwave through traffic on a roadway, in either direction. A symptom can be a change in traffic variables of traffic flow such as traffic density, mean rate of flow, and mean speed of vehicles. For example, a symptom of a traffic incident could be detected by comparing a change in the rate of traffic to a threshold value. In order for a shockwave to develop, traffic conditions—namely the traffic density—must be above a certain threshold (i.e. a critical density). If the traffic conditions of a particular roadway do not meet the threshold requirements, symptoms may fail to propagate along the travel path in a detectable and predictable way, thus altering the ability of the method to account for sensor location based on time-to-detection guarantees.

Consistent with embodiments, the speed and direction of a shockwave depend on the traffic conditions on either side of the shock-front. This is given by:

$$\frac{dx_t^s}{dt} = \frac{Q_e(\rho(x_t^s -, t)) - Q_e(\rho(x_t^s +, t))}{\rho(x_t^s -, t) - \rho(x_t^s +, t)}, \tag{C}$$

where $x_t^s$ denotes the position of the shock-front at time t and $x_t^s-$ and $x_t^s+$ denote, respectively, the positions immediately upstream and immediately downstream the shock-front. For example, $x_t^s-$ can denote a position immediately upstream of a traffic flow, while $x_t^s$ can denote a position immediately downstream (i.e. following further along a path in the same direction) of a traffic flow. As a special case, in the presence of a single discontinuity within a road section and uniform traffic densities upstream and downstream the shock-front, denoted $\rho_u$ and $\rho_d$, the shock speed would be a constant given by:

$$v^s = \frac{Q_e(\rho_u) - Q_e(\rho_d)}{\rho_u - \rho_d} \tag{D}$$

Consistent with some embodiments, a distance between sensors can be determined following the model and using the formulations described hereafter. The basic formulation of the model is the determining the distance between detectors such that the time-to-detection guarantees can be satisfied for all incident locations between two detectors. Let the vector l* represent the vector of distances between successive detectors. On a linear network such as an expressway network, given a starting point in space, the problem of determining l* reduces to a set of separable problems, one for every $l_i$, solved in sequence from the starting point, $x_0$.

Proposition 1 The maximal time to detection of an incident occurs when the incident takes place at a distance $\epsilon$ upstream of a detector.

Corollary 1 The minimal inter-detector distance l necessary to satisfy a time-to-detection β is given by the time taken by a backward propagating wave to traverse the distance l.

Then, by Proposition 1 and Corollary 1 basic problem for a given section $l_i$, is to find l* that solves:

$$\max_{l \geq 0} l \tag{1}$$

such that $$t(l) \leq \beta \tag{2}$$

In a particular example, where the flow-density relationship is constant and equal to a constant wave speed, v, the time-to-detection function t(l): $R_+ \rightarrow R_+$ is a scalar function mapping the length of the interval to the target minimal detection time β and is given by l/v. In this case, the value of l that uniquely satisfies the optimization problem (1)-(2) is $l^* = v\beta$. In more general cases, t(l) is a nonlinear set of equations and in other cases may be represented by a black box simulation model.

According to some embodiments, a distance can be calculated using a model described below. On a linear network such as an expressway network, it can be shown that the problem of determining l* reduces to a set of separable problems, one for every $l_j$. Suppose an incident takes place within a homogeneous roadway section of length l at position $x^i$ and time $t^i$. Assume traffic conditions are in free-flow throughout the roadway section prior to time $t^i$. That is, all kinematic waves propagate into the downstream prior to time $t^i$. The onset of the incident can trigger a shockwave that propagates into the upstream (i.e. the build-up of a queue or traffic back up the highway) which is detected at the upstream end of the roadway at some time $t^u > t^i$. It can also result in a drop in traffic densities at the downstream end of the roadway section (i.e. downstream propagating free-flow waves) at some time $t^d > t^i$. Both detections s are needed to corroborate an incident within the roadway section. Hence, the incident detection time is given by to $t^u \vee t^d$.

Proposition 2.1. Suppose traffic conditions throughout a roadway section of length l are governed by a piecewise concave flow-density relation, Q. Then, the maximal time to detection of a traffic incident occurs when $x^i = l$.

Corollary 2.1. The minimal inter-detector distance l necessary to satisfy a time-to-detection β is given by the time taken by a backward propagating shockwave to traverse the distance l.

Then, by Proposition 2.1 and Corollary 2.1 l* is determined by solving a sequence of problems, starting from $l_0 = L$ and determining the maximum $\Delta l_j = l_{j-1} - l_j$ such that the maximum time, $t(\Delta l_1)$, to detect an incident at $l_{j-1}$ is bounded by β. That is, the following can be solved sequentially:

$$l_j = l_{j-1} - \underset{l>0}{\operatorname{argmax}}\{l : t(l) \le \beta\} \tag{3}$$

When the entire length of the roadway section [0,L] has the same flow density relation Q, l* is partitioned into segments of equal length l* with the exception, potentially, of one of the segments, which would have a length l<l* to ensure an integer number of detectors.

According to embodiments, and as mentioned above, models provided herein need not be constrained by generalizations made throughout. For example, the above mentioned could be generalized to the setting where [0,L] is not homogeneous in Q, but consists of finite number of homogeneous sections as is typically the case in real-world road networks. For example, a highway with entrance and exit ramps at each mile would not be homogenous, but could consist of a number of homogenous sections of highway, wherein traffic is assumed to not be exiting or entering outside of the entrance and exit ramps. In this case, consider the set $\mathcal{J} = \{1, \mathcal{J}, \ldots, 1\}$ of homogeneous sections and denote by $l_j$ the position of the $j^{th}$ segment boundary (decreasing in j).

Let $$v_j^s = \frac{-\sup R_j}{\sup D_j - \bar{\rho}_{c,j}}$$

be defined analogously to (4) for each homogeneous section. Then t(l) is given by:

$$t(l) = \sum_{j=1}^{|\mathcal{J}|} \left( \frac{l_j - l_{j-1}}{v_j^s} 1_{\{l \ge l_j\}} + \frac{l - l_{j-1}}{v_j^s} 1_{\{l_{j-1} \le l \le l_j\}} \right) \tag{5}$$

In general, t(l) is a strictly increasing function of l. Consequently, (3) may be equivalently formulated as:

$$l_j = l_{j-1} - t^{-1}(\beta) \tag{6}$$

and the problem is reduced to sequentially solving for $t^{-1}(\beta)$.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 6:
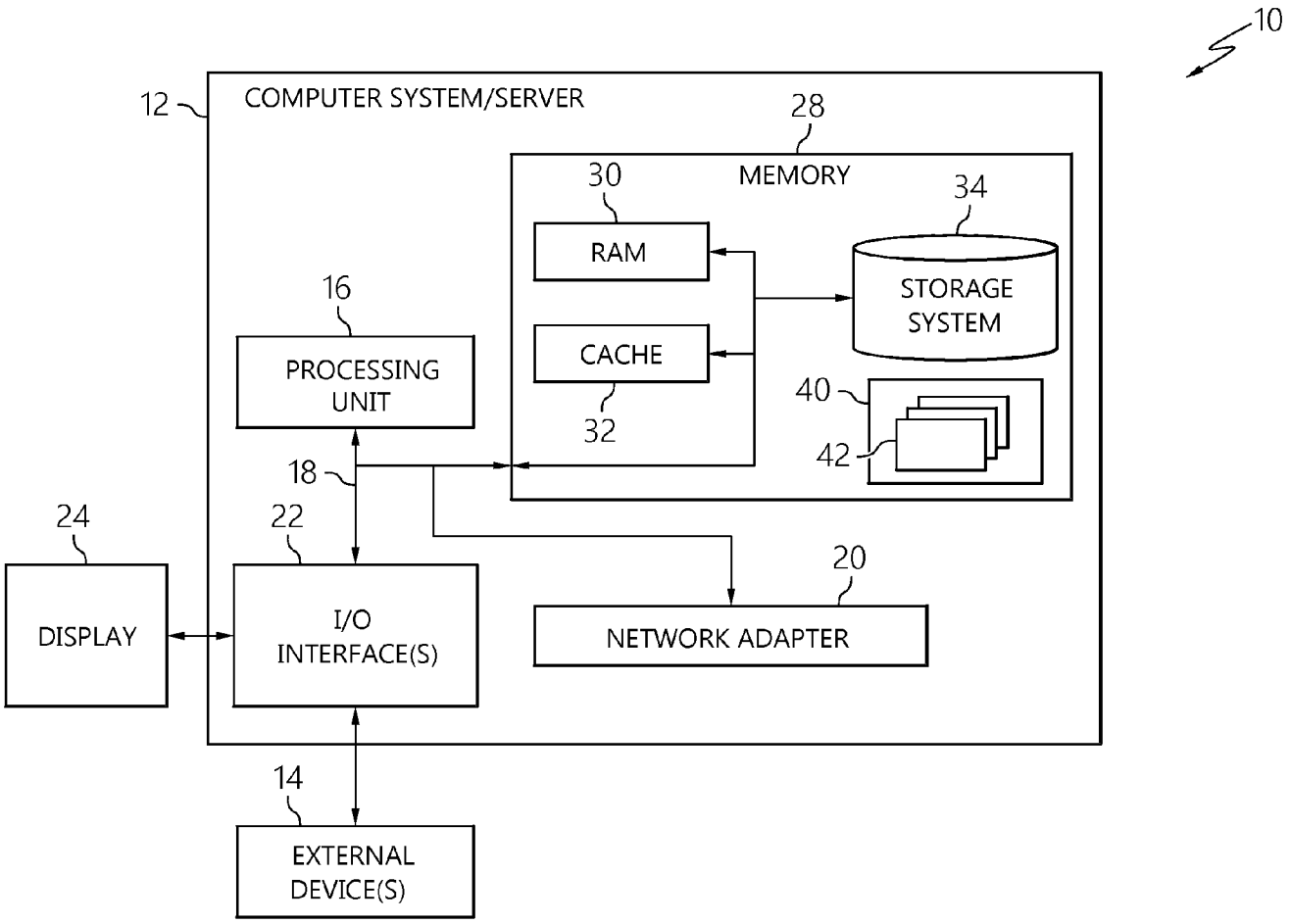
FIG. 6 depicts a cloud computing node according to an embodiment of the present invention.

Referring now to FIG. 6, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 6, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 7:
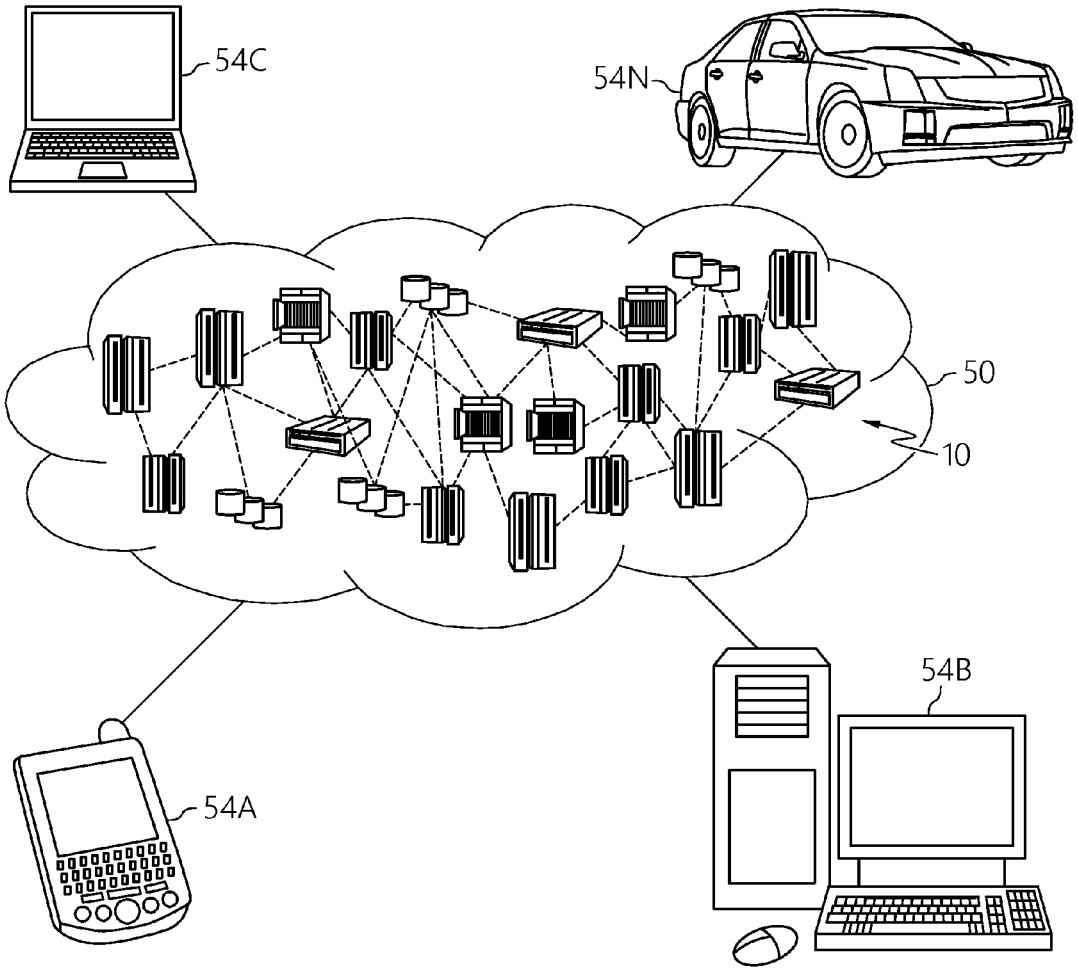
FIG. 7 depicts a cloud computing environment according to an embodiment of the present invention.

Referring now to FIG. 7, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 7 are intended to be illustrative only and that computing nodes 10 and cloud computing environment 50 can communicate with any type of computerized device over any type of network and/or network addressable connection (e.g., using a web browser).

Figure 8:
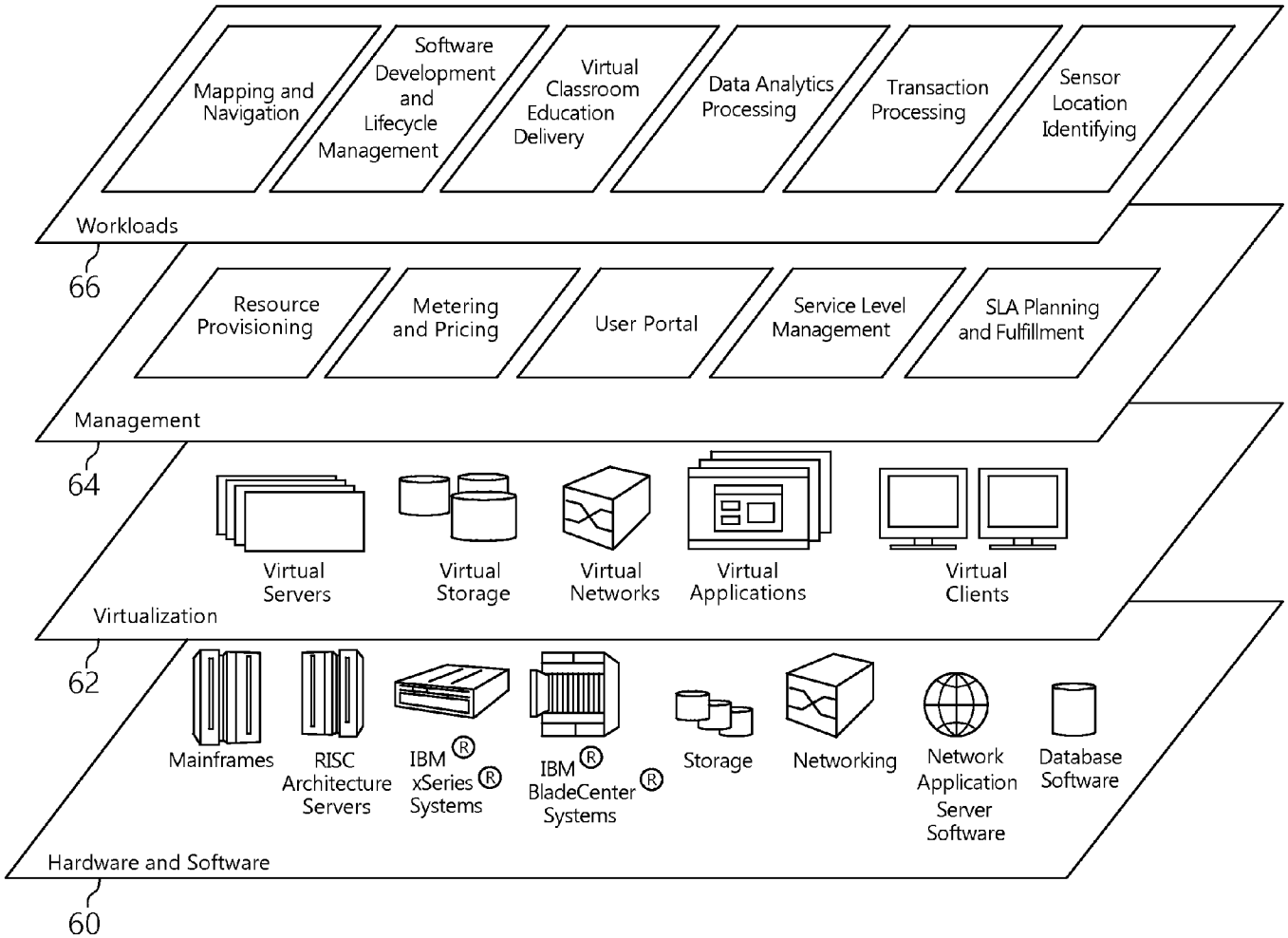
FIG. 8 depicts abstraction model layers according to an embodiment of the present invention.

Referring now to FIG. 8, a set of functional abstraction layers provided by cloud computing environment 50 (FIG. 7) is shown. It should be understood in advance that the components, layers, and functions shown in FIG. 8 are intended to be illustrative only and embodiments of the invention are not limited thereto. As depicted, the following layers and corresponding functions are provided:

Hardware and software layer 60 includes hardware and software components. Examples of hardware components include: mainframes; RISC (Reduced Instruction Set Computer) architecture based servers; storage devices; networks and networking components. In some embodiments, software components include network application server software.

Virtualization layer 62 provides an abstraction layer from which the following examples of virtual entities may be provided: virtual servers; virtual storage; virtual networks, including virtual private networks; virtual applications and operating systems; and virtual clients.

In one example, management layer 64 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide prearrangement for, and procurement of, cloud computing resources for which a future requirement is anticipated in accordance with an SLA.

Workloads layer 66 provides examples of functionality for which the cloud computing environment may be utilized. Examples of workloads and functions which may be provided from this layer include: mapping and navigation; software development and lifecycle management; virtual classroom education delivery; data analytics processing; transaction processing; and identifying a location for sensor placement.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A computer implemented method comprising:

identifying a particular segment of a travel path that has traffic flow characteristics;

accessing, based upon the traffic flow characteristics, traffic flow data for segments of a set of travel paths, the traffic flow data collected from sensors along the set of travel paths;

generating, based on the accessed traffic flow data, parameters for a traffic incident symptom propagation model;

determining, based upon the traffic incident symptom propagation model for the particular segment, a traffic incident location along the particular segment of the travel path wherein the determining the traffic incident location comprises determining, based on incident symptom propagation speed functions for an upstream symptom and a downstream symptom, a traffic incident location relative to an incident symptom propagation speed function for an upstream and downstream symptom;

determining, based on a first time-to-detection limit and using the traffic incident symptom propagation model, an upstream distance;

determining, based on the first time-to-detection limit and using the model, a downstream distance;

outputting, based upon the upstream and downstream distances, a sensor location on the particular segment of the travel path for a first sensor and a second sensor;

transmitting the first sensor location at a first end of the particular segment of the travel path and the second sensor location at a second end of the particular segment of the travel path; and displaying, on a display, the first sensor location and the second sensor location.

2. The method of claim 1, wherein the traffic flow characteristics comprise a traffic density threshold; and wherein the method further comprises generating the traffic incident symptom propagation model using the traffic density threshold.

3. The method of claim 1, wherein the method further comprises determining a location for a third sensor on the travel path, based on another traffic incident symptom propagation model, for another particular segment of the travel path between the second and third sensors.

4. The method of claim 3, wherein the determining the location for the third sensor comprises:

identifying the another particular segment of the travel path between the second and third sensors;

determining, based on another time-to-detection limit, an upstream distance between the second and third sensors;

determining, based on the another time-to-detection limit, a downstream sensor downstream distance between the second and third sensors; and outputting, based upon the upstream distance and the downstream distance between the second and third sensors, the third sensor location at an end of the another particular segment of the travel path.

5. The method of claim 1, wherein the particular segment of the travel path comprises a roadway with no new traffic entering or exiting the roadway over the particular segment of the travel path.

6. A computer system comprising:

at least one processor circuit having:

a path identifier module configured to:

identify a particular segment of a travel path that has traffic flow characteristics; and access, based upon the traffic flow characteristics, traffic flow data for segments of a set of travel paths, the traffic flow data collected from sensors along the set of travel paths;

a developer module configured to:

generate, based on the accessed traffic flow data, parameters for a traffic incident symptom propagation model; and determine, based upon the traffic incident symptom propagation model for the particular segment, a traffic incident location along the particular segment of the travel path, wherein the determining the traffic incident location comprises determining, based on incident symptom propagation speed functions for an upstream symptom and a downstream symptom, a traffic incident location relative to an incident symptom propagation speed function for an upstream and downstream symptom;

a distance determining module configured to:

determine, based on a specified time-to-detection limit and using the model, an upstream distance; and determine, based on the specified time-to-detection limit and using the model, a downstream distance; and a report module configured to:

output, based upon the upstream and downstream distances, a sensor location on the particular segment of the travel path for a first sensor and a second sensor;

transmit the first sensor location at a first end of the particular segment of the travel path and the second sensor location at a second end of the particular segment of the travel path; and display, on a display, the first sensor location and the second sensor location.

7. The system of claim 6, wherein the traffic flow characteristics comprise a traffic density threshold; and wherein the developer module is further configured to generate the traffic incident symptom propagation model using the traffic density threshold.

8. The system of claim 6, wherein the at least one processor circuit is configured to determine a location for a third sensor on the travel path, based on another traffic incident symptom propagation model, for another particular segment of the travel path between the second and third sensors.

9. The system of claim 8, wherein the at least one processor circuit is configured to determine the location for the third sensor by:

identifying the another particular segment of the travel path between the second and third sensors;

determining, based on another time-to-detection limit, an upstream distance between the second and third sensors;

determining, based on the another time-to-detection limit, a downstream sensor downstream distance between the second and third sensors; and outputting, based upon the upstream and downstream distance between the second and third sensors, the third sensor location at an end of the another particular segment of the travel path.

10. The system of claim 6, wherein the particular segment of the travel path comprises a roadway with no new traffic entering or exiting the roadway over the particular segment of the travel path.

11. A computer program product comprising a computer readable storage medium having program instructions embodied therewith, wherein the computer readable storage medium is not a transitory signal per se, the program instructions executable by a computer processing circuit to cause the circuit to perform the method comprising:

identifying a particular segment of a travel path that has traffic flow characteristics;

accessing, based upon the traffic flow characteristics, traffic flow data for segments of a set of travel paths, the traffic flow data collected from sensors along the set of travel paths;

generating, based on the accessed traffic flow data, parameters for a traffic incident symptom propagation model;

determining, based upon the traffic incident symptom propagation model for the particular segment, a traffic incident location along the particular segment of the travel path, wherein the determining the traffic incident location comprises determining, based on incident symptom propagation speed functions for an upstream symptom and a downstream symptom, a traffic incident location relative to an incident symptom propagation speed function for an upstream and downstream symptom;

determining, based on a first time-to-detection limit and using the traffic incident symptom propagation model, an upstream distance;

determining, based on the first time-to-detection limit and using the model, a downstream distance;

outputting, based upon the upstream and downstream distances, a sensor location on the particular segment of the travel path for a first sensor and a second sensor;

transmitting the first sensor location at a first end of the particular segment of the travel path and the second sensor location at a second end of the particular segment of the travel path; and displaying, on a display, the first sensor location and the second sensor location.

12. The computer program product of claim 11, wherein the traffic flow characteristics comprise a traffic density threshold; and wherein the method further comprises generating the traffic incident symptom propagation model using the traffic density threshold.

13. The computer program product of claim 11, wherein the method further comprises determining a location for a third sensor on the travel path, based on another traffic incident symptom propagation model, for another particular segment of the travel path between the second and third sensors.

14. The computer program product of claim 13, wherein the determining the location for the third sensor comprises:

identifying the another particular segment of the travel path between the second and third sensors;

determining, based on another time-to-detection limit, an upstream distance between the second and third sensors;

determining, based on the another time-to-detection limit, a downstream sensor downstream distance between the second and third sensors; and outputting, based upon the upstream distance and the downstream distance between the second and third sensors, the third sensor location at an end of the another particular segment of the travel path.

15. The computer program product of claim 11, wherein the particular segment of the travel path comprises a roadway with no new traffic entering or exiting the roadway over the particular segment of the travel path.

* * * * *